US011898566B2

(12) United States Patent
Vidalenc et al.

(10) Patent No.: US 11,898,566 B2
(45) Date of Patent: Feb. 13, 2024

(54) MOTOR-DRIVEN COMPRESSOR HAVING A COMPRESSION SECTION MOUNTED ON A FREE END OF A CANTILVERED SHAFT

(71) Applicant: Thermodyn SAS, Le Creusot (FR)

(72) Inventors: Yoann Vidalenc, Le Creusot (FR); Benjamin Defoy, Le Creusot (FR); Thomas Alban, Le Creusot (FR)

(73) Assignee: Nuovo Pignone Technolgie SRL, Florence (IT)

( * ) Notice: Subject to any disclaimer, the term of this patent is extended or adjusted under 35 U.S.C. 154(b) by 272 days.

(21) Appl. No.: 17/320,914

(22) Filed: May 14, 2021

(65) Prior Publication Data

US 2022/0074418 A1 Mar. 10, 2022

Related U.S. Application Data

(63) Continuation of application No. PCT/EP2019/025407, filed on Nov. 20, 2019.

(30) Foreign Application Priority Data

Nov. 21, 2018 (FR) ..... 1871647

(51) Int. Cl.
*F04D 25/06* (2006.01)
*F04D 17/10* (2006.01)
(Continued)

(52) U.S. Cl.
CPC ..... *F04D 25/06* (2013.01); *F04D 17/10* (2013.01); *F04D 29/054* (2013.01);
(Continued)

(58) Field of Classification Search
None
See application file for complete search history.

(56) References Cited

U.S. PATENT DOCUMENTS 4,708,587 A * 11/1987 Katayama ..... F04D 29/0516 415/104
6,564,560 B2 * 5/2003 Butterworth ..... H02K 9/20 62/505

(Continued)

FOREIGN PATENT DOCUMENTS

EP 0 301 285 * 2/1989 ..... F04D 29/04
EP 0301285 A1 2/1989

(Continued)

*Primary Examiner* — Nathan C Zollinger
*Assistant Examiner* — Timothy P Solak
(74) *Attorney, Agent, or Firm* — Paul Frank + Collins P.C.

(57) ABSTRACT

A motor-driven compressor equipped with multiple compression sections, the motor-driven compressor including, at least one housing, at least two drive shafts, the at least two drive shafts being rotatably supported in the housing by at least two bearings, a flexible coupling device connecting the drive shafts, an electric motor mounted on a first compression shaft of the at least two drive shafts, and at least two compression sections. A first compression section of the at least two compression sections is cantilevered at a free end of a first compression shaft of the at least two drive shafts, and a second compression section is mounted between two bearings on a second compression shaft of the at least two drive shafts.

15 Claims, 5 Drawing Sheets

(51) Int. Cl.

| | |
|---|---|
| ***F04D 29/054*** | (2006.01) |
| ***F04D 29/058*** | (2006.01) |
| *F04D 25/00* | (2006.01) |
| *F04D 25/16* | (2006.01) |
| *F04D 29/051* | (2006.01) |
| *F04D 25/02* | (2006.01) |

(52) U.S. Cl.
CPC ..... *F04D 29/058* (2013.01); *F04D 25/02* (2013.01); *F04D 25/0606* (2013.01); *F04D 25/16* (2013.01); *F04D 29/051* (2013.01)

(56) References Cited

U.S. PATENT DOCUMENTS

| | | | | |
|---|---|---|---|---|
| 2004/0179961 | A1 | 9/2004 | Pugnet et al. | |
| 2014/0037422 | A1* | 2/2014 | Gilarranz | F04D 17/12 415/146 |
| 2015/0093256 | A1 | 4/2015 | Mariotti et al. | |
| 2016/0186764 | A1* | 6/2016 | Lissoni | F04D 17/12 417/423.1 |
| 2016/0218590 | A1* | 7/2016 | Oxman | F04D 29/041 |
| 2017/0009774 | A1* | 1/2017 | Calafell | F04D 29/584 |

FOREIGN PATENT DOCUMENTS

| | | | |
|---|---|---|---|
| FR | 644751 | A | 10/1928 |
| WO | 2012/057885 | A1 | 5/2012 |
| WO | 2015/032756 | A1 | 3/2015 |
| WO | 2017/013218 | A1 | 1/2017 |
| WO | 2017/153387 | A1 | 9/2017 |

* cited by examiner

MOTOR-DRIVEN COMPRESSOR HAVING A COMPRESSION SECTION MOUNTED ON A FREE END OF A CANTILVERED SHAFT

CROSS-REFERENCE TO RELATED APPLICATIONS

This application is the U.S. national stage application filed pursuant to 35 U.S.C. 365(c) and 120 as a continuation of International Patent Application No. PCT/EP2019/025407, filed Nov. 20, 2019, which application claims priority from French Patent Application No. 1871647, filed Nov. 21, 2018, which applications are incorporated herein by reference in their entireties.

TECHNICAL FIELD

The present invention relates to a motor driven compressor equipped with multiple compression sections and more particularly to the arrangement of the compression sections.

BACKGROUND

A motor-driven compressor equipped with multiple compression sections includes a housing comprising an electric motor mounted on a drive shaft and intended for driving at least one compression section forming a compression line. A compression section includes one or more compression wheels for compressing a gas, mounted on the drive shaft.

The drive shaft is held in the housing by bearings.

When the rotational speeds are high, for example of the order of 30000 revolutions per minute, the compression sections and the motor are generally located between two active magnetic bearings so that the shaft is levitated.

Since the nominal rotation speed of the compression shaft is generally greater than that of its first bending mode, when starting up and shutting down the electric motor, the drive shaft, on which the compression sections and the rotor of the electric motor, passes through the first bending mode, causing deformation of the shaft.

It is necessary to size the active magnetic bearings so as to damp the dynamic response of the shaft.

However, these large magnetic capacity bearings are sized for a transient state of the shaft. They are expensive and are driven by expensive electronic devices.

High rotational speed motor-driven compressors comprising a compression shaft on which are mounted an electric motor and a compression section at each end of the shaft are known from the state of the art. An active magnetic bearing is arranged between a compression section and the electric motor.

The compression sections are cantilevered to increase the value of the critical speed of the compression shaft so that it is greater than the value of the nominal speed of the electric motor.

The active magnetic bearings and the electronic control devices are sized for the nominal operation of the motor-driven compressor in order to reduce the magnetic capacity of the bearings and consequently the cost of the bearings.

However, the connection flanges of the gas inlet and outlet are arranged in an axial direction of the propeller shaft.

Any intervention on the compression wheels or on the electric motor involves dismantling the pipes connected to the flanges.

In addition, each section includes a single compression wheel limiting the wheel selection.

The variation range of the compression ratio and the speed of the motor-driven compressor is low.

For low pressure applications, for example when the motor-driven compressor compresses a gas from atmospheric pressure to a pressure of 10 bar and a low flow rate of the order of 2000 cubic meters per hour, the entire compression line may include five compression wheels.

Reference can be made to WO2017/153387 which illustrates a motor-driven compressor in which an expansion wheel is cantilevered.

The gas is expanded when passing in the single cantilevered wheel.

Reference may also be made to WO2015/032756 which illustrates a centrifugal compressor comprising a compression section mounted on a compression shaft between two bearings and a compression wheel mounted at a free end of the cantilevered shaft on the compressor side and comprising a trapped bearing.

An electric motor is intended to be connected to the shaft.

As all the elements are mounted on the drive shaft, the bearings are solicited by all the elements mounted on the shaft, reducing the value of the critical speed of the first bending mode.

In addition, the trapped bearing complicates the maintenance of the compressor.

Therefore, it is proposed to overcome the disadvantages associated with the restricted selection of wheels by widening the operating range of the motor-driven compressor and to facilitate maintenance of the motor-driven compressor, while allowing operation at a nominal rotational speed of less than the critical speed of the first bending mode.

SUMMARY

In view of the above, it is proposed a motor-driven compressor with multiple compression sections, the motor-driven compressor comprising:

- at least one housing,
- at least two transmission shafts, the at least two transmission shafts being supported in rotation in the housing by at least two bearings;
- a flexible coupling device connecting the drive shafts;
- an electric motor mounted on a first compression shaft of said at least two drive shafts; and
- at least two compression sections.

A first compression section of said at least two compression sections is cantilevered at a free end of a first compression shaft of said at least two drive shafts and a second compression section is mounted between two bearings on a second compression shaft of said at least two drive shafts.

Preferably, the first compression shaft has a first free end and is rotatably supported by a first pair of bearings.

Advantageously, the second compression shaft has a second free end and is rotatably supported by a second pair of bearings.

According to one feature, a flexible coupling device is connected to the first compression shaft and the second drive shaft.

Preferably, a first compression section is cantilevered to the free end of the first drive shaft.

Advantageously, a second compression section is mounted between the second pair of bearings of the second drive shaft.

According to another feature, the motor-driven compressor further comprises:

- one or more additional compression sections mounted on the second compression shaft; and a bearing separating said additional compression section from an adjacent compression section.

Preferably, the motor-driven compressor further comprises:

a third compression shaft rotatably supported in the housing by at least two bearings; and a second flexible coupling device connecting the third shaft to the second free end of the second compression shaft; and at least one additional compression section mounted on the third shaft between the two bearings.

Advantageously, the second flexible coupling device is connected to the second compression shaft and the third drive shaft.

According to another feature, the third compression shaft comprises a third free end and is rotatably supported by a third pair of bearings.

Preferably, each compression section comprises at least one compression wheel.

Advantageously, the cantilevered compression section comprises two compression wheels.

Preferably, each compression section comprises:

an inlet flange; and an outlet flange, said flanges being arranged perpendicular to the drive shafts.

According to another feature, at least one compression section mounted between two bearings comprises two compression half-sections so that, during rotation of the drive shaft, the thrust generated by a half-section compensates for the thrust generated by the drive shaft. other half-section.

Preferably, each compression half-section comprises:

an inlet flange; and an output flange, said flanges being arranged perpendicular to the drive shafts.

Advantageously, the bearings comprise active magnetic bearings.

Preferably, the motor-driven compressor further comprises an axial thrust abutment mounted on each compression shaft which comprises at least one compression section so as to control the axial displacement of the compression shaft as a result of thrust forces exerted by the compression section and/or the electric motor.

BRIEF DESCRIPTION OF THE DRAWINGS

Other features and advantages of the invention will appear on reading the following description of embodiments of the invention, given solely by way of nonlimiting examples and with reference to the drawings in which.

DETAILED DESCRIPTION OF THE DRAWINGS

Figure 1:
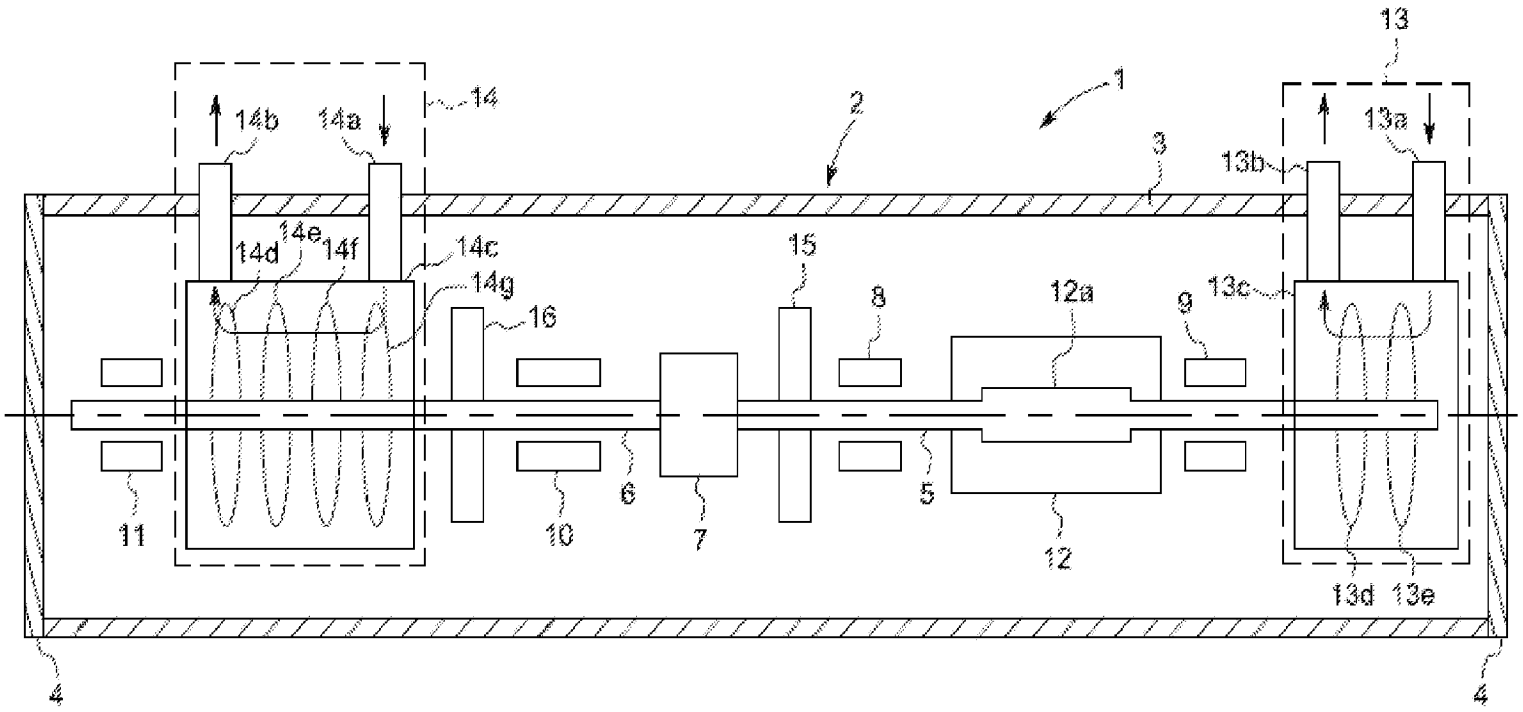
FIG. 1 illustrates a first embodiment of a motor-driven compressor.

Referring is made to FIG. 1 which illustrates a first embodiment of a motor-driven compressor 1 compressing, for example, a gas from a gas field or an associated gas from a petroleum field.

The motor-driven compressor 1 comprises a housing 2 comprising a hollow elongated body 3 and a cover 4 at each of its ends so as to make the housing gas-tight, and two drive shafts 5 and 6 connected to each other by means of a flexible coupling device 7.

The flexible coupling device 7 makes it possible to separate the bending modes of the shafts 5 and 6 and to dynamically balance each shaft, the vibratory behaviors of the shafts being independent.

The first shaft 5 is supported in rotation in the housing 2 by two bearings 8 and 9, and the second shaft 6 is rotatably supported in the housing 2 by two bearings 10 and 11.

The first, second, third and fourth bearings 8, 9, 10 and 11 are identical and comprise, for example, active magnetic bearings controlled by a control device (not shown).

The motor-driven compressor 1 further comprises an electric motor 12 driving in rotation the first and second shafts 5 and 6 and whose rotor 12*a* is mounted on the first shaft 5 between the first and second bearings 8 and 9.

A first compression section 13 is cantilevered at the free end of the first shaft 5 and a second compression section 14 is mounted between the third and fourth bearings 10 and 11 on the second shaft 6.

Each compression section 13 and 14 comprises a gas inlet flange 13*a* and 14*a*, an outlet flange 13*b* and 14*b* of the gas compressed by the compression section 13 and 14, and a cartridge 13*c* and 14*c* connected to a first end of the inlet and outlet flanges.

The inlet and outlet flanges are intended to be connected to gas treatment devices, for example a gas cooler, a compressed gas storage device, a supply device of gas at atmospheric pressure.

Each cartridge 13*c* and 14*c* comprises compression wheels 13*d*, 13*e*, 14*d*, 14*e*, 14*f* and 14*g* cooperating with diaphragms (not shown) so as to compress the gas received on the inlet flange 13*a* and 14*a*.

A first axial thrust abutment 15 is mounted on the first shaft 5 between the first bearing 8 and the flexible coupling device 7, and a second axial thrust abutment 16 is mounted on the second shaft 6 between the third bearing 10 and the second compression section 14.

The first and second axial thrust abutments 15 and 16 take up the forces exerted respectively by the electric motor and the compression sections on the shafts during the compression of a gas. They make it possible to control the axial displacement of the shafts 5 and 6 as a result of the thrust forces exerted by the motor or the compression sections.

The number and location of the axial thrust abutments mounted on each shaft are determined so as to limit the axial displacement of each shaft comprising at least one compression section.

The first compression section 13 may comprise one or more compression wheels, preferably two wheels 13*d* and 13*e*.

The second compression section 14 may comprise one or more compression wheels, preferably no more than five wheels.

The number of wheels of each compression section and the features of each of the wheels are determined in order to optimize the efficiency of the motor-driven compressor in the range of flow and pressure in which the motor-driven compressor 1 operates, and in order to minimize the stresses exerted on the bearings.

Preferably, in this embodiment, the selection generally comprises a maximum of seven wheels.

As the flexible coupling device 7 makes it possible to separate the bending modes of the first and second shafts, the first and second bearings 8 and 9 are sized according to the dynamic stresses generated mainly by the first compression section 13 and the rotor 12*a* of the electric motor 12, the stresses generated by the other elements mounted on the shaft being negligible, and the third and fourth bearings 10 and 11 are sized according to the dynamic stresses generated mainly by the second compression section 14, the other elements mounted on the shaft being negligible.

As the inlet flange 13*a*, and the outlet flange 13*b* are arranged perpendicular to the compression shaft 5, the compression wheels of the first compression section 13 are easily accessible by disassembling the cover 4 and can be easily replaced when they are deteriorated or if the compression ratio of the motor-driven compressor 1 has to be modified, for example if the pressure of the received gas fluctuates according to the operating phase of the gas field.

It is not necessary to disassemble the body 3 and to disassemble the gas treatment devices connected to the inlet and outlet flanges of the motor-driven compressor 1.

Preferably, the first compression section 13 receives on its inlet flange 13*a* the gas entering the first time in the motor-driven compressor 1 generally wet promoting the corrosion and erosion of the compression wheels.

According to other embodiments, the housing 2 may comprise several housings connected to each other, for example a motor housing comprising the motor 12 and the first compression section 13 and a compressor housing comprising the second compression section 14.

According to still other embodiments, the housing 2 may comprise a motor housing comprising the motor 12, a first compressor housing comprising the second compression section 14 and a second compressor housing comprising the first compression section 13.

Figure 2:
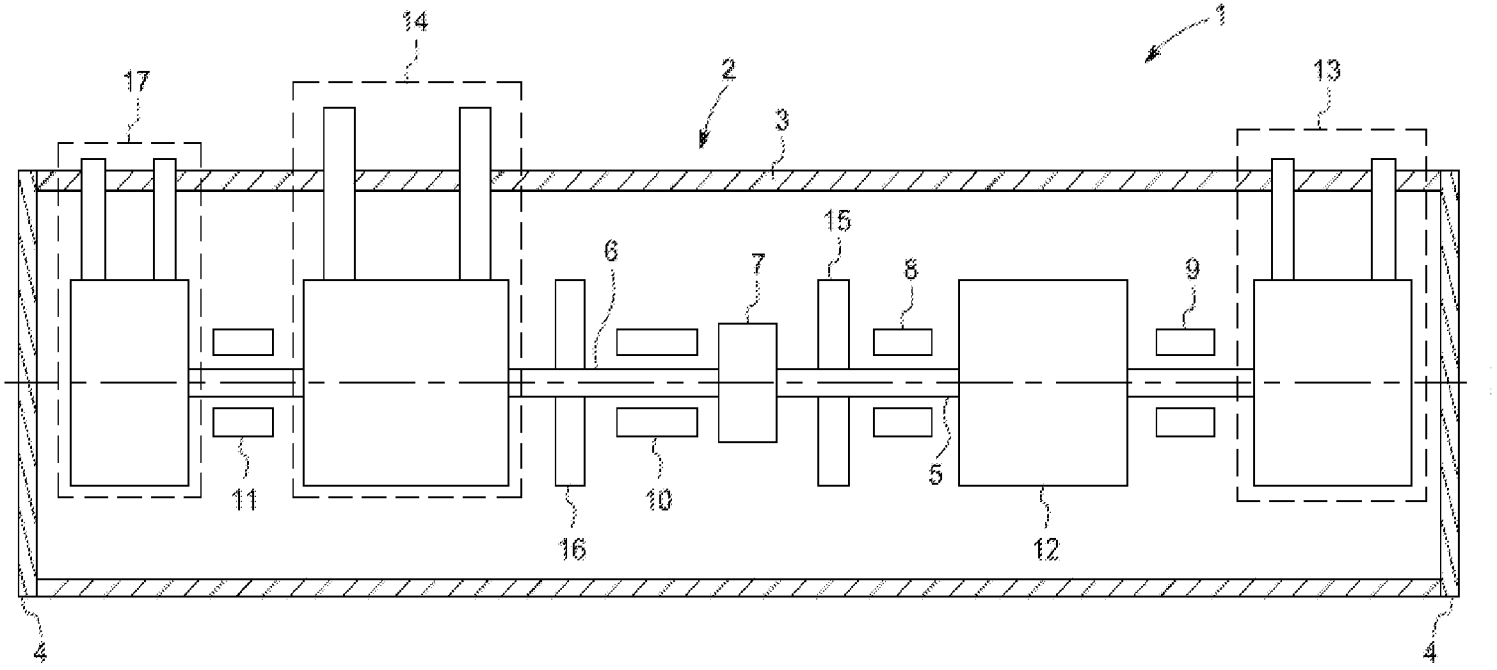
FIG. 2 illustrates a second embodiment of a motor-driven compressor.

In what follows, the elements identical to those described above are identified by the same alphanumeric references Reference is made to FIG. 2 which illustrates a second embodiment of the motor-driven compressor 1.

This embodiment differs from the first embodiment in that a third compression section 17 is cantilevered to the free end of the second shaft 6.

The third compression section 17 is identical in architecture to the first compression section 13 and preferably comprises two compression wheels.

As in the case of the first compression section 13, the wheels of the third compression section 17 are easily accessible by disassembling the cover 4.

The additional compression section makes it possible to increase the wheel selection. Consequently, the pressure ratio generated by the motor-driven compressor 1 is higher than in the embodiment illustrated in FIG. 1.

The pressure and operating flow ranges of the motor-driven compressor 1 are extended compared with those of the first embodiment.

In this embodiment, the third and fourth bearings 10 and 11 are sized according to the dynamic stresses generated mainly by the second and third compression sections 14 and 17, the dynamic stresses due to the other elements mounted on the shaft being negligible.

Figure 3:
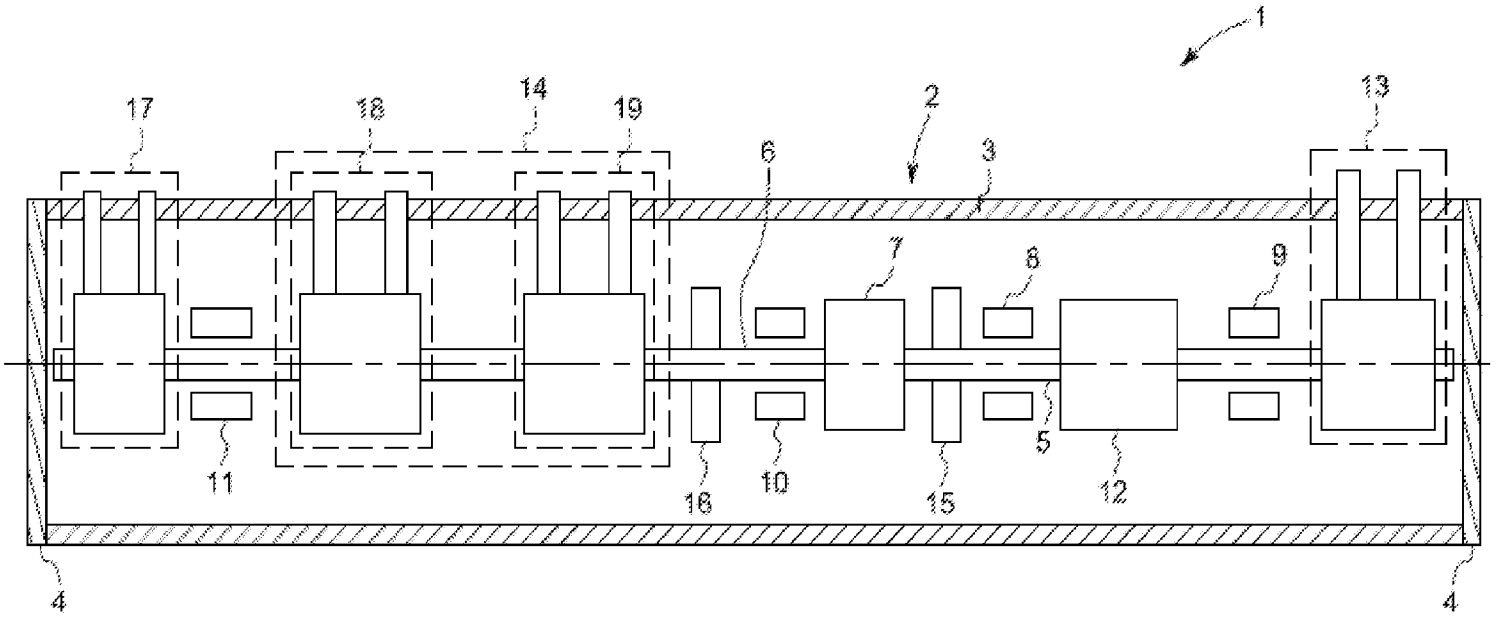
FIG. 3 illustrates a third embodiment of a motor-driven compressor.

FIG. 3 illustrates a third embodiment of the motor-driven compressor 1 which differs from the second embodiment in that the second compression section 14 comprises two compression half-sections 18 and 19, each of architecture identical to that of the compression sections 13 and 17.

The two half-sections 18 and 19 are mounted on the second shaft 6 so that, during the rotation of the shaft, the thrust generated by the first half-section 18 compensates for the thrust generated by the second half-section 19, reducing thus the thrust generated by the second compression section 14 and transmitted to the second axial thrust abutment 16.

Such an arrangement is known as "back to back".

Of course, any compression section that is not cantilevered may comprise two compression half-sections.

Figure 4:
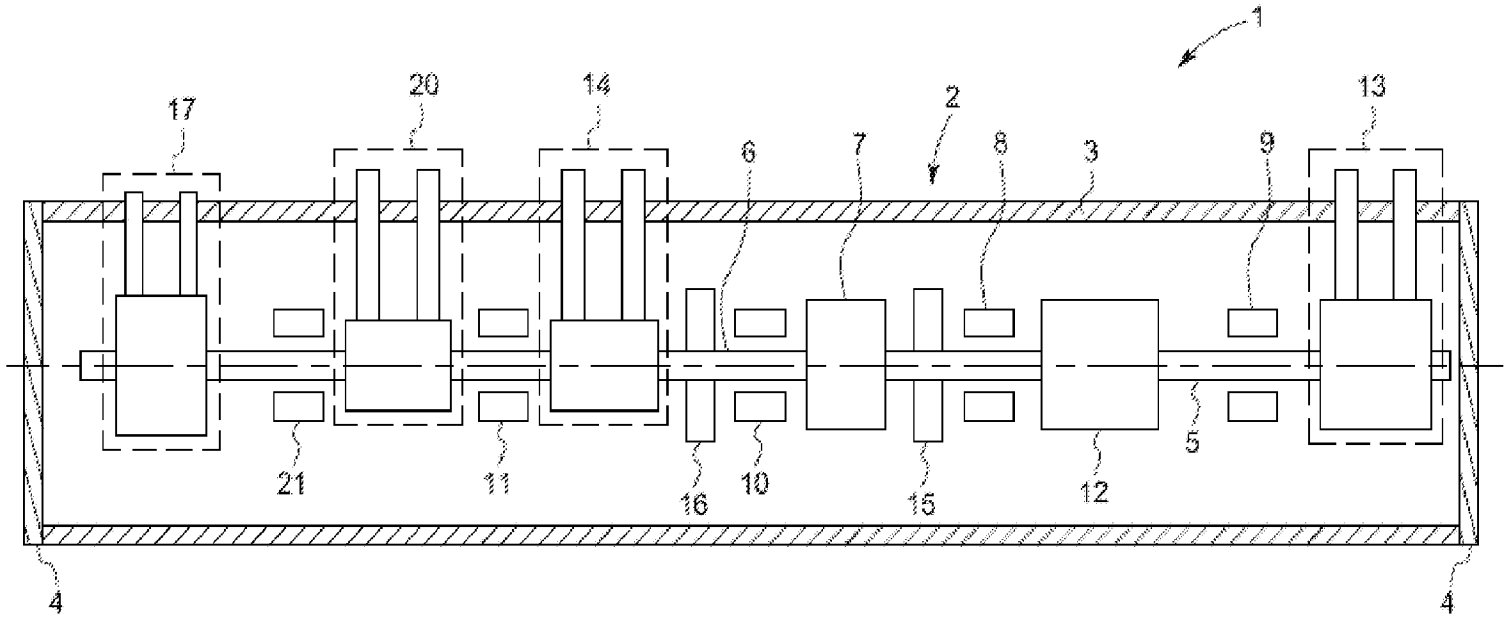
FIG. 4 illustrates a fourth embodiment of a motor-driven compressor.

FIG. 4 illustrates a fourth embodiment of the motor-driven compressor 1 further comprising a fourth compression section of identical architecture to the first, second and third compression sections, and preferably comprising five compression wheels.

This embodiment differs from the second embodiment in that a fourth compression section 20 is mounted on the second shaft 6 between the second and third compression sections 14 and 17.

The fourth compression section 20 is separated from the second compression section 14 and 17 by the fourth bearing 11, and from the third compression section 17 by a fifth bearing 21.

The number and features of the wheels of the compression sections are selected in order to limit the stresses exerted on the bearings and in order to reach the desired compression ratio.

The addition of at least a fourth compression section makes it possible to adapt the motor-driven compressor to compression applications of a light gas with a high compression ratio, for example pure methane compressed at a pressure ratio greater than 10.

Furthermore, the addition of compression sections or compression half-sections optimizes the cooling of the gas after each compression step.

Indeed, it is easy to add a gas cooler between the outlet flange of a compression section and the inlet flange of the adjacent compression section.

Figure 5:
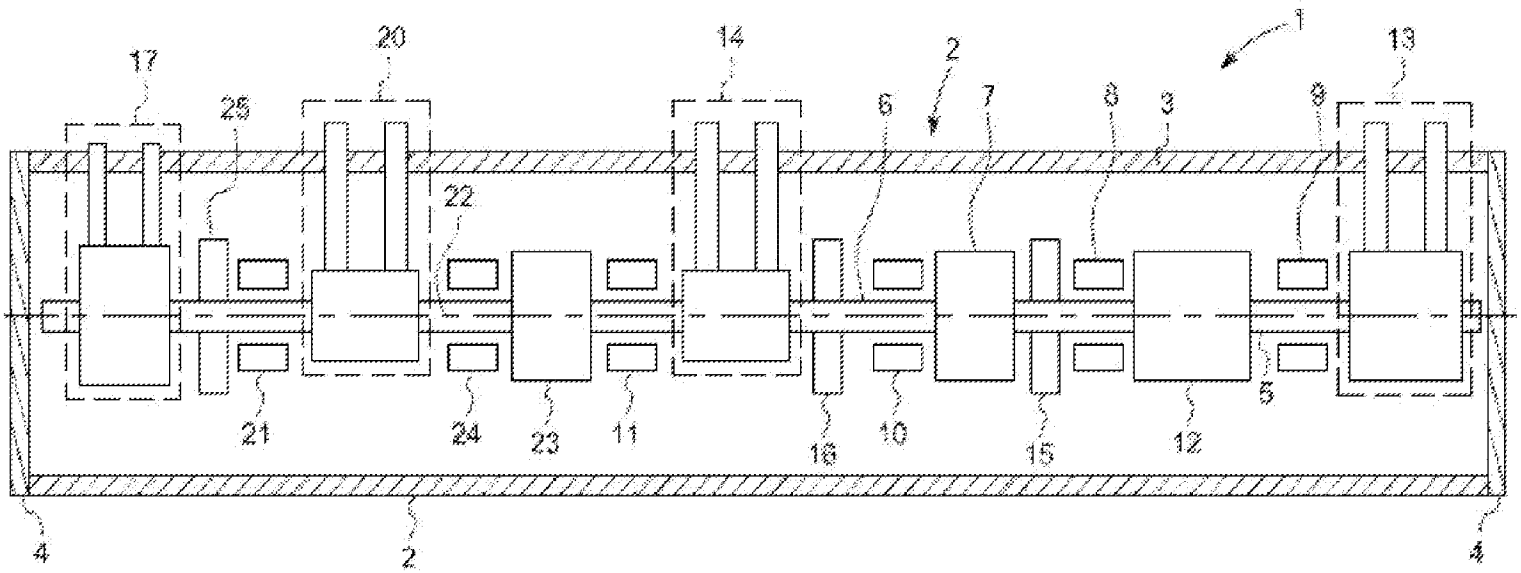
FIG. 5 illustrates a fifth embodiment of a motor-driven compressor.

Reference is made to FIG. 5 which illustrates a fifth a third [sic] embodiment of the motor-driven compressor 1. This embodiment differs from the fourth embodiment in that one of the third and fourth compression sections 17 and 20, and the fifth bearing 21 are mounted on a third shaft 22 connected to the free end of the second shaft 6 by a second flexible coupling device 23.

The third compression section 17 is cantilevered at the free end of the third shaft 22 and the fourth compression section 20 is mounted between the fifth bearing 21 and a sixth bearing 24 arranged between the second flexible coupling device 23 and the fourth compression section 20.

The third shaft 22 further comprises a third axial thrust abutment 25 mounted between the third compression section 17 and the fifth bearing 21.

Compared to the fourth embodiment, for the same number of compression sections, the second flexible coupling device 23 makes it possible to separate the bending modes of the second and third shafts, thus increasing the value of the critical speed of the first bending mode of the drive shafts on which the second, third and fourth compression sections 14, 17 and 20 are mounted.

In this embodiment, the third and fourth bearings 10 and 11 are sized according to the dynamic stresses generated mainly by the second compression section 14, and the fifth and sixth bearings 21 and 24 are sized according to the dynamic stresses generated mainly by the third and fourth compression section 17 and 20, the dynamic stresses due to other elements mounted on the second and third shafts 6 and 22 being negligible.

Advantageously, the cantilevered arrangement of at least one compression section and the use of a flexible coupling device make it possible to increase the value of the critical speed of the first bending mode of the drive shafts to a value greater than that of the nominal operating speed of the motor-driven compressor.

Consequently, the bearings supporting the shafts can be sized without taking into account the passage of the shafts through their first bending mode, thereby reducing the magnetic capacity of the bearings.

In addition, the mounting of at least one cantilevered compression section facilitates the replacement of the wheels mounted in said section.

The invention claimed is:

1. A motor-driven compressor with multiple compression sections, the motor-driven compressor comprising:

a housing;

a first compression drive shaft and a second compression drive shaft, both being rotatably supported in the housing by bearings comprising a first pair of bearings on the first compression shaft and a second pair of bearings on the second compression drive shaft;

a flexible coupling device connecting the first compression drive shaft and the second compression drive shaft;

an electric motor mounted on the first compression shaft between the first pair of bearings;

at least two compression sections comprising a first compression section that is cantilevered at a free end of the first compression shaft, and a second compression section that is mounted between the second pair of bearings on the second compression shaft;

a first thrust abutment mounted on the first compression shaft between one of the first pair of bearings and the flexible coupling device; and a second thrust abutment mounted on the second compression shaft between one of the second pair of bearings and the second compression section.

2. The motor-driven compressor according to claim 1, further comprising:

a third compression section mounted on the second compression shaft; and a bearing separating the third compression section from the second compression section.

3. The motor-driven compressor according to claim 1, further comprising:

a third compression shaft rotatably supported in the housing by a third pair of bearings;

a second flexible coupling device connecting the third compression shaft to the second compression shaft; and a third compression section mounted on the third compression shaft between the third pair bearings.

4. The motor-driven compressor according to claim 1, wherein the first compression section and the second compression section each comprises a compression wheel.

5. The motor-driven compressor according to claim 1, wherein the first compression section comprises two compression wheels.

6. The motor-driven compressor according to claim 1, wherein the first compression section and the second compression section each comprises:

an inlet flange; and an outlet flange, wherein the inlet flange and the outlet flange are arranged perpendicular to the first drive shaft and the second drive shaft.

7. The motor-driven compressor according to claim 1, wherein the second compression section comprises two compression half-sections so that, during the rotation of the drive shaft, the thrust generated by a half-section compensates for the thrust generated by the other half-section.

8. The motor-driven compressor according to claim 7, wherein each compression half-section comprises:

an inlet flange; and an outlet flange, wherein the inlet flange and the outlet flange are arranged perpendicular to the first drive shaft and the second drive shaft.

9. The motor-driven compressor according to claim 1, wherein the first pair of bearings comprise active magnetic bearings.

10. The motor-driven compressor according to claim 1, wherein the second pair of bearings comprise active magnetic bearings.

11. The motor-driven compressor according to claim 1, wherein the first pair of bearings and the second pair of bearings comprise active magnetic bearings.

12. The motor-driven compressor according to claim 1, wherein the first compression section is configured to receive gas at atmospheric pressure.

13. The motor-driven compressor according to claim 1, wherein the second compression section is configured to receive gas at atmospheric pressure.

14. A system comprising the motor-driven compressor according to claim 1 and a gas cooler attached to the first compression section.

15. The system of claim 14, further comprising a gas cooler attached to the second compression section.

* * * * *